US008712271B2

(12) United States Patent
Nakayama et al.

(10) Patent No.: US 8,712,271 B2
(45) Date of Patent: Apr. 29, 2014

(54) IMAGE FORMING APPARATUS

(75) Inventors: Toshinori Nakayama, Kashiwa (JP); Masayuki Tamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/280,794

(22) Filed: Oct. 25, 2011

(65) Prior Publication Data

US 2012/0107002 A1 May 3, 2012

(30) Foreign Application Priority Data

Nov. 2, 2010 (JP) ..... 2010-245850

(51) Int. Cl.
*G03G 15/20* (2006.01)

(52) U.S. Cl.
USPC ..... 399/69

(58) Field of Classification Search
USPC ..... 399/69
See application file for complete search history.

(56) References Cited

U.S. PATENT DOCUMENTS

| | | | |
|---|---|---|---|
| 7,260,351 | B2 | 8/2007 | Nakayama |
| 7,263,303 | B2 | 8/2007 | Nakayama |
| 7,280,777 | B2 | 10/2007 | Takahashi et al. |
| 7,343,130 | B2 | 3/2008 | Nakayama |
| 7,421,220 | B2 | 9/2008 | Takahashi et al. |
| 7,430,392 | B2 | 9/2008 | Ito et al. |
| 7,460,821 | B2 | 12/2008 | Ai et al. |
| 7,505,724 | B2 | 3/2009 | Nakayama |
| 7,590,366 | B2 | 9/2009 | Nakayama |
| 7,729,628 | B2 | 6/2010 | Nakayama |
| 7,907,861 | B2 | 3/2011 | Nakayama |
| 8,559,837 | B2 | 10/2013 | Nakayama |
| 2005/0220467 | A1 | 10/2005 | Takahashi et al. |
| 2006/0251451 | A1* | 11/2006 | Ishigami et al. ..... 399/328 |
| 2008/0013977 | A1 | 1/2008 | Takahashi et al. |
| 2009/0092409 | A1 | 4/2009 | Chiyoda et al. |
| 2010/0284706 | A1 | 11/2010 | Ito et al. |
| 2011/0305473 | A1 | 12/2011 | Tamaki |
| 2012/0027477 | A1 | 2/2012 | Nakayama |

FOREIGN PATENT DOCUMENTS

| | | | |
|---|---|---|---|
| JP | 1-263685 | A | 10/1989 |
| JP | 2005-266079 | A | 9/2005 |
| JP | 2005-292333 | A | 10/2005 |
| JP | 2006-003404 | A | 1/2006 |

(Continued)

OTHER PUBLICATIONS

Japanese Office Action dated Feb. 25, 2014, issued in counterpart Japanese Application No. 2010-245850, and English-language translation thereof.

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

In an image forming apparatus including an image forming unit which forms an image in which toner containing a wax is used on a recording material, and a fixing device which heats the toner image formed on the recording material at a nip portion which nips and conveys the recording material, when the fixing device heats the recording material on which a toner image having a maximum toner-carrying amount of toner is formed, when a temperature of a surface of the toner layer reaches a temperature at which an endothermic amount indicates a peak in a relationship between a temperature of the toner and the endothermic amount, a condition of the fixing device at the nip portion is set so that a temperature of an interface between the toner and the recording material is lower than a temperature of a surface of the toner.

8 Claims, 12 Drawing Sheets

(56) References Cited

FOREIGN PATENT DOCUMENTS

| | | | |
|---|---|---|---|
| JP | 2006-091146 A | 4/2006 | * cited by examiner |
| JP | 4449512 B2 | 4/2010 | |
| JP | 4517796 B2 | 8/2010 | |

*FIG. 7*

| | TEMPERATURE OF PRESSURE ROLLER | GLOSS LEVEL | GLOSS VARIATION |
|---|---|---|---|
| COMPARATIVE EXAMPLE | 60~110°C | 10~20 | × |
| EMBODIMENT | 50~70°C | 20~35 | ○ |

IMAGE FORMING APPARATUS

BACKGROUND OF THE INVENTION

1. Field of the Invention

The present invention relates to an image forming apparatus including an image heating device that heats an image formed on a recording material using toner containing a toner-parting agent.

2. Description of the Related Art

Conventionally, in an image forming apparatus, such as a printer and a copying machine, which uses an electrophotographic process, an image formed on a recording material by toner formed of a binder resin is heated by an image heating device. As the image heating device, a fixing device is often used, which uses a heat-roller method in which a recording material is sandwiched, conveyed, and heated by a heating roller (fixing roller) kept at a predetermined temperature and a pressure roller that has an elastic layer and presses the heating roller.

In particular, an image forming apparatus that forms a color image generally uses color toner of cyan, magenta, yellow, and the like, and generally uses nonmagnetic toner formed of a material having sharp-melting properties with a low melting point and a low melt viscosity compared with monochrome toner.

When fixing such a color image, color mixing properties are required for the toner, and toner having high sharp-melting properties and excellent melting characteristics is preferable. However, toner having high sharp-melting properties tends to be offset if toner-parting properties from the surface of a fixing roller are not sufficient when the toner is fixed.

To improve the toner-parting properties, a fixing method of an oil-coating method, in which silicon oil or the like is coated on the surface of the fixing roller, is conventionally used. However, there is an issue that the apparatus becomes complicated because an oil-coating device needs to be provided. Further, there is an issue that an oil-streak-gloss variation occurs due to the oil-coating variation.

Therefore, an oilless fixing method which uses oilless toner in which a toner-parting agent, such as paraffin wax, polyethylene wax, and silicon wax, is added to toner and a fixing roller, having a fluororesin surface layer, has been developed.

However, it is known that, in an oilless fixing device using the above-described oilless toner containing wax, the gloss of an image changes depending on the cooling state of the fixed toner and the wax. This is because the degree of crystallinity, the degree of transparency, and the surface properties change depending on the solidification state of the wax. The techniques described below related to a gloss-variation issue generated by a variation of the solidification state of the wax are known.

For example, in the invention discussed in Japanese Patent Laid-Open No. 2005-266079, it is prevented that diffuse reflection and incident light absorption occur due to wax components deposited on an image surface of the recording material, and image gloss degradation as well as muddy color occur. Specifically, in the invention, the above-described wax is removed after fixing.

In the invention discussed in Japanese Patent Laid-Open No. 2006-091146, it is prevented that a toner image on a recording material discharged from a fixing device comes into contact with a conveying roll and the like, to prevent wax on the surface of the toner image from rapidly cooled below the melting-point temperature, thereby preventing a roller mark from occurring when the wax crystallizes. Specifically, a heating roll of the fixing device has many small holes and the melted wax is absorbed.

In the invention discussed in Japanese Patent Laid-Open No. 2006-003404, it is prevented that a contact scar, which is a so-called roller mark (roll mark), occurs in a toner image when a member such as a roller comes into contact with the fixed toner image. Specifically, the recording material is conveyed in a state in which no member comes into contact with the toner image that has passed through a fixing unit until the temperature of the toner image heated by the fixing unit falls below the melting-point temperature of the wax component.

However, the image forming apparatuses described above have issues described below.

In Japanese Patent Laid-Open No. 2005-266079, wax is removed after fixing. However, it is difficult to evenly and uniformly remove wax on the image surface after fixing, and a gloss variation due to removal variation occurs after long-term use.

In Japanese Patent Laid-Open No. 2006-091146, the heating roll has many small holes and the melted wax is absorbed. However, in the same manner as described above, it is difficult to evenly and uniformly remove wax by the absorption, and a gloss variation due to removal variation occurs after long-term use.

In Japanese Patent Laid-Open No. 2006-003404, a conveying-system configuration is used in which a conveying roller does not come into contact with the surface of the toner image until the temperature falls below the melting-point temperature of the wax. However, in a case of a high-speed machine having a high conveying speed, there is an issue that the length of a conveying portion, in which the conveying roller does not come into contact with the surface of the toner image, is very long and the size of an apparatus main body increases significantly. Even when the wax on the surface of the toner image solidifies, if the wax inside the toner image does not solidify, only the surface of the toner layer is hardened, and the entire toner layer including a lower layer does not have rigidity. In such a state, when the surface of the toner layer comes into contact with a member such as a conveying roller, a conveying guide, and a separation claw, not only the surface of the toner layer, but also the lower layer are deformed, so that a gloss variation occurs.

On the other hand, when the wax of the toner solidifies, if the wax solidifies from the lower layer of the toner layer and thereafter a portion near the surface of the toner layer solidifies, uniform surface properties can be obtained and the gloss of the image increases.

SUMMARY OF THE INVENTION

The present invention provides an image forming apparatus that can reduce the gloss variation due to wax contained in toner.

To achieve the above object, the present invention provides an image forming apparatus including an image forming portion which forms an image in which toner containing a toner-parting agent is used on a recording material, an image heating means which heats the toner image formed on the recording material at a nip portion which nips and conveys the recording material, and a setting portion which sets a condition of the image heating means at the nip portion so that a temperature of an interface between the toner and the recording material is lower than a temperature of a surface of the toner when the temperature of the surface of the toner layer reaches a temperature at which an endothermic amount indicates a peak in a relationship between a temperature of the toner and the endothermic amount in the case that the image heating device heats the recording material on which a toner image having a maximum toner-carrying amount of toner is formed.

Further features of the present invention will become apparent from the following description of exemplary embodiments with reference to the attached drawings.

BRIEF DESCRIPTION OF THE DRAWINGS

FIG. 7 is a table illustrating a relationship among the temperature of a pressure roller, the gloss level, and the gloss variation in which the present embodiment and a comparative example are compared;

DESCRIPTION OF THE EMBODIMENTS

Hereinafter, embodiments of the present invention will be described by examples in detail. However, the sizes, materials, and shapes of the constituent components described in the embodiments below and relative arrangements thereof should be appropriately modified according to the configuration and various conditions of the apparatus to which the present invention is applied. Therefore, unless otherwise specifically described, the scope of the present invention is not limited by these embodiments.

First Embodiment

Figure 1:
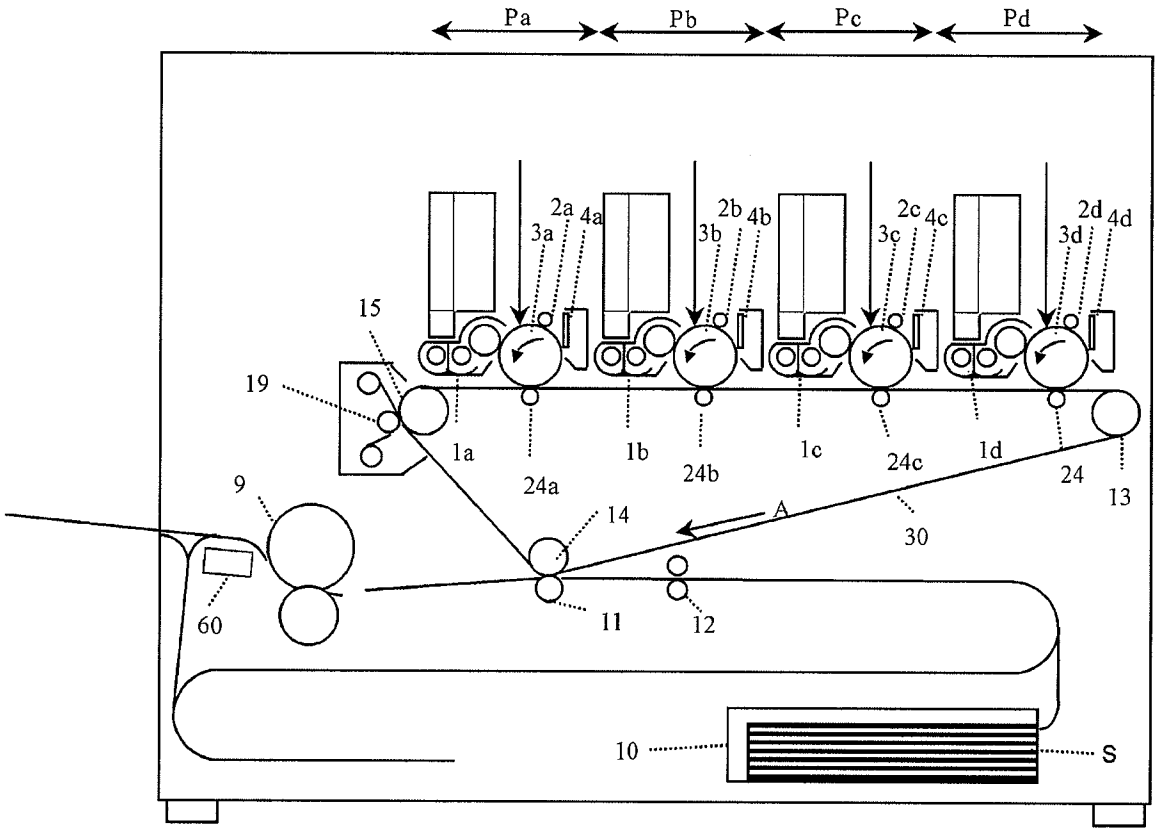
FIG. 1 is a schematic cross-sectional view of an image forming apparatus according to a first embodiment.

<Image Forming Portion> A plurality of image forming portions is provided in parallel in the image forming apparatus illustrated in FIG. 1. Each image forming portion is an image forming unit that forms an image (hereinafter referred to as toner image) using toner containing a toner-parting agent on a recording material. Here, four image forming portions, which are a first image forming portion Pa, a second image forming portion Pb, a third image forming portion Pc, and a fourth image forming portion Pd, are provided in parallel. In each image forming portion, a toner image of a color different from each other is formed through processes of latent image, development, and transfer.

The image forming portions Pa, Pb, Pc, and Pd include dedicated image bearing members, that is, electrophotographic photosensitive drums 3*a*, 3*b*, 3*c*, and 3*d*, respectively. Toner images of each color are formed on the electrophotographic photosensitive drums 3*a*, 3*b*, 3*c*, and 3*d*. An intermediate transfer member 30 is disposed adjacent to each electrophotographic photosensitive drum 3*a*, 3*b*, 3*c*, and 3*d*. The toner images of each color formed on the electrophotographic photosensitive drums 3*a*, 3*b*, 3*c*, and 3*d* are primarily transferred onto the intermediate transfer member 30, and collectively transferred (secondarily transferred) onto a recording material S in a secondary transfer portion. Further, the recording material S on which the toner image is transferred is heated and pressed in a fixing device 9 to fix the toner image, and then discharged to the outside of the apparatus.

On the circumferences of the electrophotographic photosensitive drums 3*a*, 3*b*, 3*c*, and 3*d*, drum chargers 2*a*, 2*b*, 2*c*, and 2*d*, development devices 1*a*, 1*b*, 1*c*, and 1*d*, primary transfer chargers 24*a*, 24*b*, 24*c*, and 24*d*, and cleaners 4*a*, 4*b*, 4*c*, and 4*d* are respectively provided. Further, a light-source device and a polygon mirror that are not illustrated in FIG. 1 are provided above the apparatus.

Laser light emitted from the light-source device is scanned by rotating the polygon mirror. A light flux of the scanned light is deflected by a reflecting mirror and focused on generating lines of the electrophotographic photosensitive drums 3*a*, 3*b*, 3*c*, and 3*d* by an fθ lens, so that the electrophotographic photosensitive drums 3*a*, 3*b*, 3*c*, and 3*d* are exposed to the scanned light. As a result, latent images according to image signals are formed on the electrophotographic photosensitive drums 3*a*, 3*b*, 3*c*, and 3*d*.

The development devices 1*a*, 1*b*, 1*c*, and 1*d* are filled with predetermined amounts of toner of yellow, magenta, cyan, and black, respectively by a supply device not illustrated in FIG. 1 as developers. The development devices 1*a*, 1*b*, 1*c*, and 1*d* develop latent images on the electrophotographic photosensitive drums 3*a*, 3*b*, 3*c*, and 3*d*, respectively, and visualize them as a yellow toner image, a magenta toner image, a cyan toner image, and a black toner image.

The intermediate transfer member 30 is driven and rotated in a direction indicated by an arrow A in FIG. 1 at the same circumferential velocity as that of the electrophotographic photosensitive drums 3. The intermediate transfer member 30 is suspended in a tensioned state by three rollers 13, 14, and 15.

The yellow toner image of a first color formed and carried on the electrophotographic photosensitive drum 3*a* is intermediately transferred onto the outer circumference surface of the intermediate transfer member 30 in a process in which the yellow toner image passes through a nip portion (primary transfer portion) between the electrophotographic photosensitive drum 3*a* and the intermediate transfer member 30 by an electric field and pressure formed by a primary transfer bias applied to the intermediate transfer member 30. Thereafter, in the same manner, the magenta toner image of a second color, the cyan toner image of a third color, and the black toner image of a fourth color are sequentially superimposed on the intermediate transfer member 30, and a synthesized color toner image corresponding to an objective color image is formed.

A secondary transfer roller 11 is disposed corresponding to the intermediate transfer member 30, pivotally supported in parallel, and caused to be in contact with the lower surface of the intermediate transfer member 30. A desired secondary transfer bias is applied to the secondary transfer roller 11 by a secondary transfer-bias source. The synthesized color toner image transferred and superimposed on the intermediate transfer member 30 is transferred onto the recording material S at the nip portion (secondary transfer portion) between the intermediate transfer member 30 and the secondary transfer roller 11. The recording material S is fed from a sheet cassette 10 included in a feeding unit by a feed roller (not illustrated in FIG. 1) one by one. Next, the recording material S is fed to the nip portion (secondary transfer portion) between the intermediate transfer member 30 and the secondary transfer roller 11 at a predetermined timing by a registration roller 12, and at the same time, the secondary transfer bias is applied to the secondary transfer roller 11 from a bias power source. The synthesized color toner image is transferred from the intermediate transfer member 30 to the recording material S by the secondary transfer bias.

Transfer residual toner is cleaned and removed from the electrophotographic photosensitive drums 3*a*, 3*b*, 3*c*, and 3*d*, where the primary transfer is completed, by respective cleaners 4*a*, 4*b*, 4*c*, and 4*d*, and the electrophotographic photosensitive drums 3*a*, 3*b*, 3*c*, and 3*d* become ready for the following formation of latent images. The toner and other foreign objects remaining on the intermediate transfer member 30 are wiped away by causing a cleaning web (nonwoven fabric) 19 to come into contact with the surface of the intermediate transfer member 30.

The recording material S on which the toner image is transferred is sequentially introduced into the fixing device 9 described below, and the toner image is fixed by applying heat and pressure to the recording material. There is a cooling fan 60 on the downstream side of the fixing device 9. The cooling fan 60 cools the recording material S being conveyed by air from the rear of the recording material. The cooling fan 60 is a cooling unit for cooling the recording material S that has passed through the nip portion of the fixing device 9 from the surface (rear surface) opposite to the surface (front surface) on which the toner layer is present.

Figure 2:
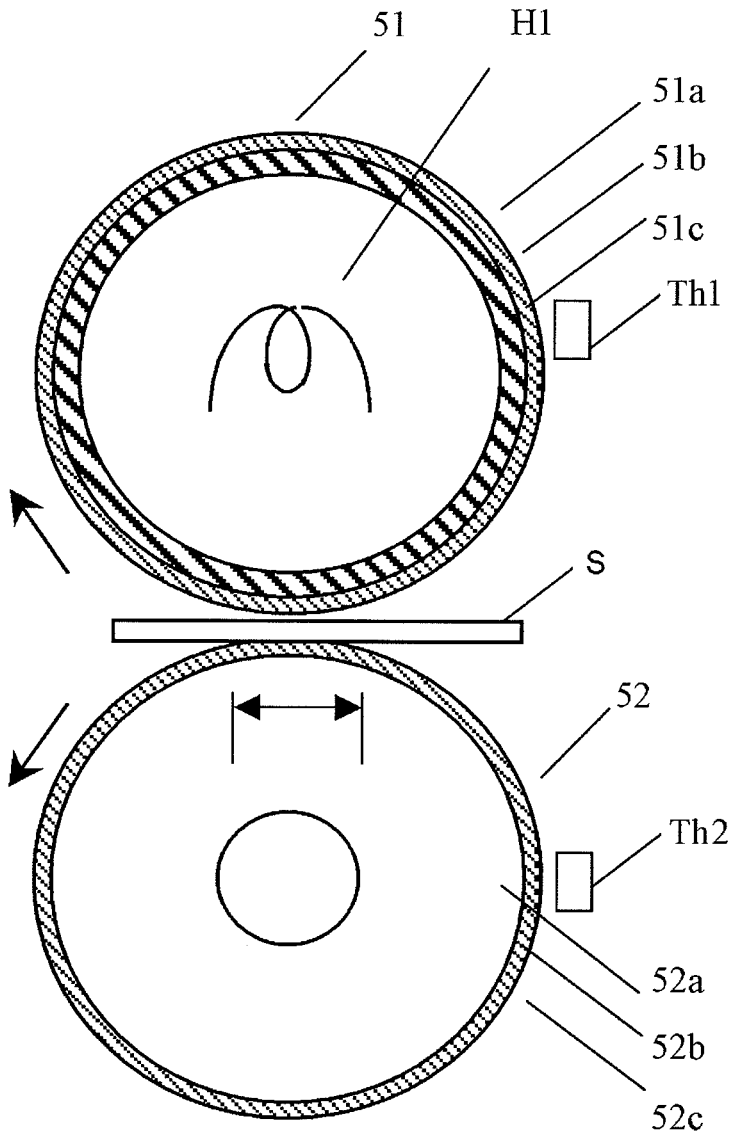
FIG. 2 is a schematic cross-sectional view of a fixing device according to the first embodiment.

<Fixing Device> Here, the fixing device 9 will be described in detail. The fixing device 9 is an image heating means, which heats the toner image formed on the recording material at the nip portion, which nips and conveys the recording material. As illustrated in FIG. 2, the fixing device 9 comes into contact with the toner image on the recording material and has a fixing roller (heating roller) 51 as an image heating member for heating the toner image and a pressure roller 52 as a pressure member for pressing the fixing roller 51. The nip portion is formed by pressing the pressure roller 52 including an elastic layer to the fixing roller 51 kept at a predetermined temperature. The fixing device 9 is a fixing device using a heat-roller method for heating the recording material while the recording material is nipped and conveyed by the nip portion including the fixing roller 51 and the pressure roller 52.

The fixing roller 51 is a heating member which comes into contact with the surface (front surface) of the recording material on which the toner layer forming the image is present. On the other hand, the pressure roller 52 is a pressure member which comes into contact with the surface (rear surface) of the recording material opposite to the surface on which the toner layer is present.

Here, as the fixing roller 51, a roller is used that has an outer diameter of about ϕ 35 mm in which a silicon rubber layer (elastic layer) 51*b* having a thickness of 1.5 mm is formed on a cylindrical metal core (hollow metal core) 51*a* formed of Al having an outer diameter of ϕ 32 mm and a thickness of 2 mm, and further a PFA tube (toner-parting property layer) 51*c* having a thickness of 50 μm is coated on the surface of the silicon rubber layer 51*b*. The cylindrical metal core 51*a* of the fixing roller 51 contains a halogen heater H1, which is a heating body (heat source) of power consumption of 900 W.

The fixing roller is connected to a drive portion not illustrated in FIG. 2 via a gear and controlled to be rotated at a predetermined fixing speed during the fixing operation.

A thermistor Th1 is provided to the fixing roller 51 as a contact or contactless temperature detection unit (temperature sensor). A heat source H1 such as a halogen heater is disposed inside the fixing roller 51. The fixing roller 51 is controlled so that the temperature of the surface of the fixing roller 51 is a predetermined temperature by the controlling portion (controlling unit) of the apparatus main body based on the detection information of the thermistor Th1.

As the pressure roller 52, a roller is used which has an outer diameter of about ϕ 30 mm in which a silicon rubber layer (elastic layer) 52*b* having a thickness of 1.0 mm is formed on a cylindrical metal core (hollow metal core) 52*a* formed of Al having an outer diameter of ϕ 28 mm, and further a PFA tube (toner-parting property layer) 52*c* having a thickness of 50 μm is coated on the surface of the silicon rubber layer 52*b*.

In the same manner as the fixing roller 51, a thermistor Th2 is provided to the pressure roller 52 as a contact or contactless temperature detection unit (temperature sensor). When the fixing device heats the recording material on which a toner image having a maximum toner-carrying amount is formed, if the surface temperature of the toner layer reaches a melting point of the toner-parting agent, condition of the fixing device at the nip portion is changed so that the temperature of the interface between the toner and the recording material is lower than the temperature of the surface of the toner. Specifically, the controlling portion (setting portion) of the apparatus main body controls the operation of the pressure roller pressure portion described below so that the surface temperature of the pressure roller 52 is maintained below a set temperature which is set lower than the melting point of the toner-parting agent contained in the toner based on the detection information of the thermistor Th2.

To obtain a desired color density of 1.6 by a single color, the toner-carrying amount needs to be 0.55 mg/cm$^2$, and the maximum toner-carrying amount to form two color solid images when forming a full color image is 1.1 mg/cm$^2$, which is two times the above value.

In the fixing device 9, the fixing roller 51 and the pressure roller 52 are caused to come into contact with each other by pressure contact of a total pressure 700 N by a pressure roller pressure portion 54 (see FIG. 3) during the fixing operation, and a fixing nip portion N having a predetermined nip width (the length in the recording material conveying direction, here, about 6 mm) is formed. When the fixing operation is not performed, the pressure by the pressure roller pressure portion 54 is released, and the fixing roller 51 and the pressure roller 52 are separated from each other, so that the temperature of the pressure roller 52 is prevented from rising. Further, as described below, even when the fixing operation is performed, the operation of the pressure roller pressure portion 54 is controlled so that the surface temperature of the pressure roller 52 is maintained below a set temperature which is set lower than the melting point of the toner-parting agent contained in the toner.

Figure 3:
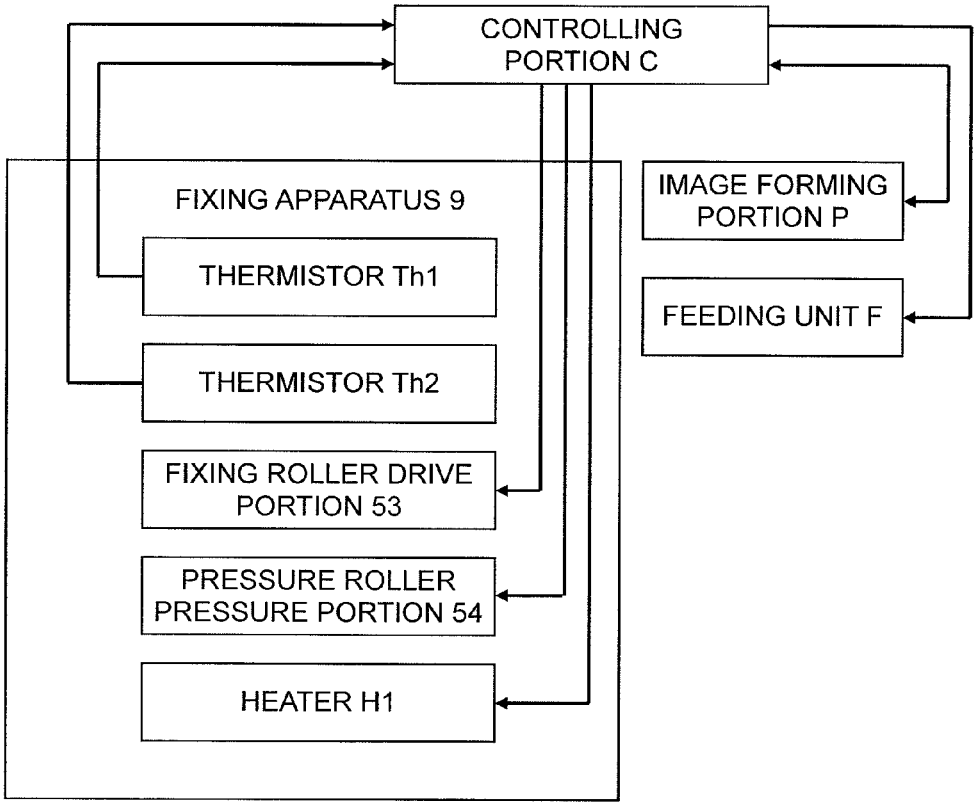
FIG. 3 is a block diagram of the image forming apparatus according to the first embodiment.

FIG. 3 illustrates a block diagram of the above-described image forming apparatus. The fixing device 9, the image forming portion P, and the feeding unit F are controlled by the controlling portion C such as a central processing unit (CPU) and a memory. A user transfers print data to the image forming apparatus by using a versatile interface not illustrated in FIG. 3 and issues an output instruction. When receiving an image output instruction, the controlling portion C transfers an image forming instruction and image data to the image forming portion P and sends a warm-up instruction to the fixing device 9. A warm-up operation of the fixing device 9 turns on the heater H1 to heat the fixing roller 51 and detects temperature of the fixing roller 51 by the thermistor Th1. When the detected temperature of the fixing roller 51 reaches a predetermined temperature, the controlling portion C prepares to feed the recording material from the feeding unit F, and at the same time, the image forming portion P starts forming an image. When the image forming operation is performed, the recording material is fed at a desired timing, and a toner image is formed on the recording material. The recording material on which the toner image is formed is conveyed to the fixing device 9. In the fixing device 9, a pressure operation by the pressure roller pressure portion 54 and a drive of the fixing roller 51 by the fixing roller drive portion 53 are started at a desired timing by the controlling portion C. When the recording material passes through the fixing nip portion N, the toner image is fixed to the recording material. During a printing operation, the controlling portion C controls the heater H1 to be turned on or off so that the surface of the fixing roller 51 is a desired temperature based on the detection temperature of the thermistor Th1. During the fixing operation, the controlling portion C controls the operation of the pressure roller pressure portion 54 so that the surface temperature of the pressure roller 52 is maintained below a set temperature which is set lower than the melting point of the toner-parting agent contained in the toner based on the detection temperature of the thermistor Th2. The control operation of the pressure roller pressure portion 54 during the fixing operation will be described below in detail with reference to FIG. 6.

<Toner> Next, toner (developer) containing wax as a toner-parting agent, which is used in the present embodiment, will be described. Examples of the binder resin of the toner include single polymer of styrene substitution such as polystyrene, poly-p-chlorostyrene, and polyvinyl toluene; styrene series copolymer such as styrene-p-chlorostyrene copolymer, styrene-vinyl toluene copolymer, styrene-vinylnaphthalene copolymer, styrene-acrylic acid ester copolymer, styrene-methacrylic acid ester copolymer, styrene-α-chloro methyl methacrylate copolymer, styrene-acrylonitrile copolymer, styrene-vinylmethylether copolymer, styrene-vinylethylether copolymer, styrene-vinyl methyl ketone copolymer, styrene-butadiene copolymer, styrene-isoprene copolymer, and styrene-acrylonitrile-indene copolymer; polyvinyl chloride, phenol resin, modified natural phenol resin, modified natural maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, and petroleum resin.

Cross-linked styrene series copolymer and cross-linked polyester resin are also the preferable binder resin. Examples of comonomer corresponding to styrene monomer of styrene series copolymer include acrylic acid, methyl acrylate, ethyl acrylate, butyl acrylate, dodecyl acrylate, octyl acrylate, acrylic acid-2-ethylhexyl, phenyl acrylate, methacrylic acid, methyl methacrylate, ethyl methacrylate, butyl methacrylate, octyl methacrylate, acrylic nitrile, methacrylonitrile, monocarboxylic acid having a double bond such as acrylamide or substitution thereof; maleic acid, butyl maleate, methyl maleate, dicarboxylic acid having a double bond such as dimethyl maleate and substitution thereof; chloroethene, vinyl acetate, vinylester such as vinyl benzoate; ethylene, propylene, ethylene series olefin such as butylene; vinyl methyl ketone, vinyl ketone such as vinyl hexyl ketone; vinylmethylether, vinyl ethyl ether, and vinyl ether such as vinyl isobutyl ether. One or two or more of these vinyl monomers are used.

As a cross-linking agent, a polymerizable compound having a double bond is used. Examples of the compound include divinylbenzene, aromatic divinyl compound such as divinyl naphthalene; ethylene glycol diacrylate, ethylene glycol dimethacrylate, carboxylic acid ester having two double bonds such as 1,3-butanediol dimethacrylate, divinyl ether, divinyl sulfide, divinyl compound such as divinyl sulfone, and a compound having three or more vinyl groups. These compounds are used as a single compound or a mixture.

When the binder resin is a styrene-acrylic copolymer, it is preferable to use a binder resin where, in molecular weight distribution of gel permeation chromatography (GPC) of THF soluble part, at least one peak is present in an area of molecular weight 3,000 to 50,000, at least one peak is present in an area of molecular weight 100,000 or more, and a component of molecular weight 100,000 or less is 50% to 90%. Further, the styrene-acrylic copolymer is preferred to have an acid value of 1 to 35 mg KOH/g.

When the binder resin is a polyester resin, it is preferable to use a binder resin where at least one peak is present in an area of molecular weight 3,000 to 50,000 and a component of molecular weight 100,000 or less is 60% to 100%. It is further preferable that at least one peak is present in an area of molecular weight 5,000 to 20,000.

For the nonmagnetic color toner for forming a full color image used in the present embodiment, a preferable binder resin is a polyester resin. The polyester resin has high stability and transparency and is suitable to color toner that requires good color mixing properties.

In particular, a polyester resin obtained by using a bisphenol derivative indicated by the formula (Chemical Formula 1) below or substitution thereof as a diol component and copolycondensating a carboxylic acid component including divalent or higher carboxylic acid, acid anhydride thereof, or lower alkyl ester thereof (for example, fumaric acid, maleic acid, maleic anhydride, phthalic acid, terephthalic acid, trimellitic acid, pyromellitic acid) has sharp-melting characteristics, so that the polyester resin is more preferably used in the present embodiment. In the formula, R indicates ethylene or propylene group, x and y respectively indicate an integer equal to or greater than 1, and an average value of x+y is 2 to 10.

[Chemical Formula 1]

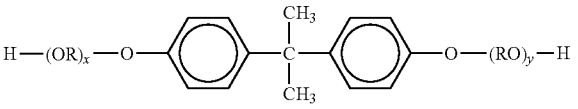

In particular, the apparent viscosity at 90° C. is $5\times10^6$ to $5\times10^8$ mPa·s, preferably $7.5\times10^6$ to $2\times10^8$ mPa·s, and more preferably $10^7$ to $10^8$ mPa·s, and the apparent viscosity at 100° C. is $10^6$ to $5\times10^7$ mPa·s, preferably $10^6$ to $3\times10^7$ mPa·s, and more preferably $10^6$ to $2\times10^7$ mPa·s, so that it is possible to obtain good results in fixing characteristics, color mixing properties, and high-temperature-tolerant offset characteristics as full color toner. It is particularly preferable that the absolute value of the difference between the apparent viscosity P1 at 90° C. and the apparent viscosity P2 at 100° C. is within a range of $2\times10^5<|P1-P2|<4\times10^6$.

Further, the polyester resin can have an acid value of 1 to 40 mg KOH/g (more preferably 1 to 20 mg KOH/g, further more preferably 3 to 15 mg KOH/g) in a point of environmental stability of charging characteristics. In the present embodiment, the polyester resin having such acid value is used.

Examples of the toner-parting agent that can be used in the present embodiment include aliphatic hydrocarbon wax such as low molecular weight polyethylene, low molecular weight polypropylene, polyolefin copolymer, polyolefin wax, microcrystalline wax, paraffin wax, and Fischer-Tropsch wax; oxide of aliphatic hydrocarbon wax such as polyethylene oxide wax; block copolymer thereof; waxes containing mainly fatty acid ester such as carnauba wax, behenyl behenate, and montanic acid ester; and partially or totally deoxidized fatty acid esters such as deoxidized carnauba wax. Further, examples of the toner-parting agent include straight-chain saturated fatty acids such as palmitic acid, stearic acid, montanoic acid, and long-chain alkyl carboxylic acids having further long-chain alkyl group; unsaturated fatty acids such as blangin acid, eleostearic acid, and parinaric acid; saturated alcohols such as stearic alcohol, aralkyl alcohol, behenyl alcohol, carnaubyl alcohol, ceryl alcohol, melissyl alcohol, and long-chain alkyl alcohols having further long-chain alkyl group; polyhydric alcohol such as sorbitol; fatty acid amide such as linoleic acid amide, oleic amide, and lauric acid amide; saturated fatty acid bisamides such as methylenebis stearic acid amide, ethylenebis capric acid amide, ethylenebis lauric acid amide, hexamethylene bis stearic acid amide, unsaturated fatty acid amides such as ethylene bis oleic acid amide, hexamethylene bis oleic acid amide, N,N'-dioleoyl adipic acid amide, and N,N'-dioleoyl sebacic acid amides; aromatic bisamides such as m-xylene bis stearic acid amide and N,N'-distearyl isophthalic acid amide; fatty acid metal salt such as calcium stearate, calcium laurate, zinc stearate, magnesium stearate (generally called metal soap); waxes obtained by grafting aliphatic hydrocarbon wax by using vinyl monomer such as styrene and acrylic acid; product obtained by partially esterifying fatty acid such as behenic acid monoglyceride and polyalcohol, and methyl ester compound having hydroxyl group obtained by hydrogenating vegetable oil. Above all, and aliphatic hydrocarbon wax such as low molecular weight polyethylene, low molecular weight polypropylene, low molecular copolymer, microcrystalline wax, paraffin wax, and Fischer-Tropsch wax are preferable. A toner-parting agent which is a long saturated straight-chain hydrocarbon with fewer branches shows excellent fixing characteristics, so that such a toner-parting agent is used in the present embodiment. It is desired that the toner of the present embodiment include one or two or more waxes. Further, from the view point of securing both low-temperature fixing performance and blocking resistance, it is desired that the toner of the present embodiment has one or a plurality of endothermic peaks within a range from 30° C. to 200° C. in an endothermic curve in a differential scanning calorimetry (DSC) measurement, and the peak temperature of the maximum endothermic peak among the endothermic peaks is within a range from 60° C. to 110° C. More preferably, the maximum peak of the endothermic curve is within a range from 65° C. to 110° C.

In the present embodiment, when the melting-point temperature of the wax is measured, the gain and loss of the heat of the wax is measured, and the behavior thereof is observed, so that it is preferable to perform the measurement by using a high-accuracy, auto-thermal, input-compensation-type, differential-scanning calorimeter from the view point of measurement principle. For example, it is possible to use DSC-7 manufactured by Perkin-Elmer Corp.

The measurement is performed in conformity with "ASTM D3418-82". When only the wax component is measured, the DSC curve used in the present embodiment is measured as follows. The wax is once heated and cooled and the previous history is recorded. Thereafter, the DSC curve is measured while the wax is heated at a temperature rate of 10° C./min. On the other hand, when the wax component contained in toner is measured, the previous history is not recorded, and the DSC curve is measured without pretreatment.

Figure 4:
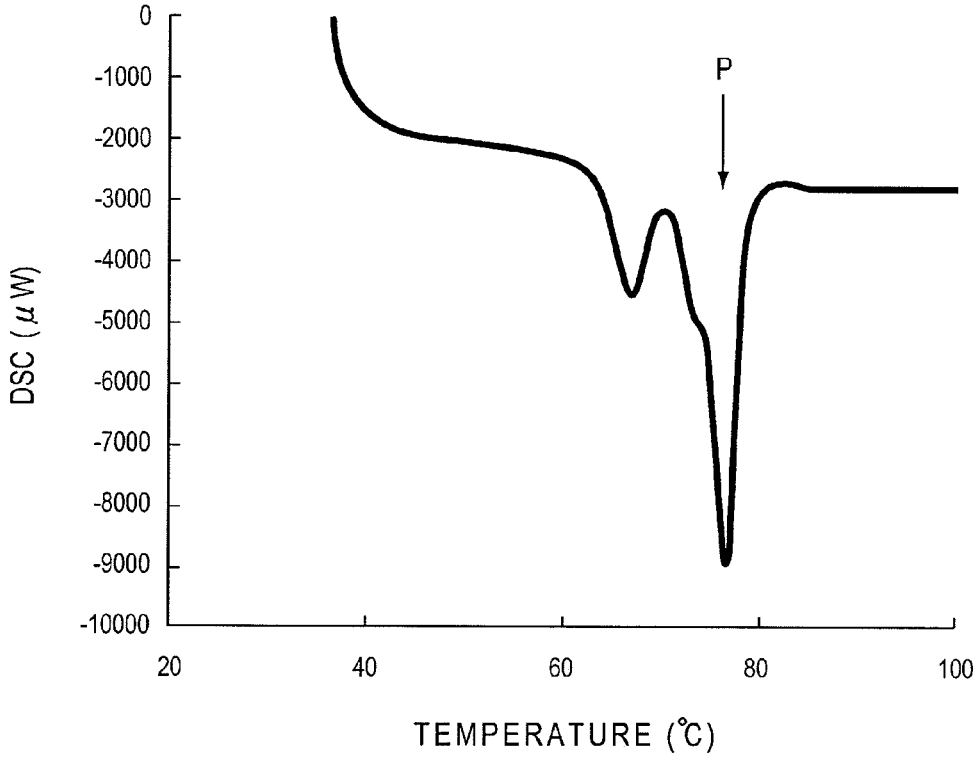
FIG. 4 is a graph illustrating a DSC curve of toner according to the first embodiment.

FIG. 4 illustrates the DSC curve of the toner of the present embodiment. In the DSC curve in which endothermic amounts (μW) are plotted with respect to temperatures (° C.), the main peak that indicates the maximum endothermic amount is observed at the point P. It is indicated that the wax, which is the toner-parting agent, is melted at the temperature of the maximum endothermic amount. In the present embodiment, a wax (toner-parting agent) having the main peak (maximum endothermic amount) at 75° C. is used, and the wax of the toner melts or solidifies at around 75° C.

If the peak temperature of the maximum endothermic amount is less than 60° C., the blocking resistance of the toner may be degraded. On the other hand, if the peak temperature of the maximum endothermic amount is higher than 110° C., the fixing performance is degraded. The toner-parting agent can be 0.5 to 10 parts by mass for 100 parts by mass of binder resin, and more preferred to be 2 to 8 parts by mass.

Figure 5:
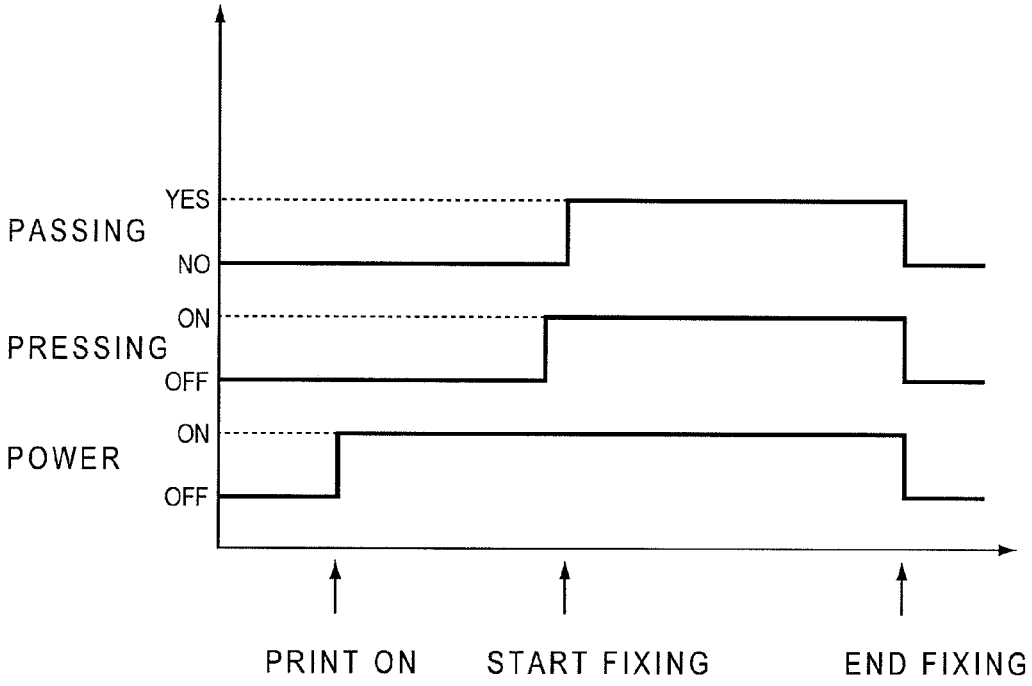
FIG. 5 is a timing chart illustrating an operation when the image forming apparatus according to the first embodiment starts printing.

<Description of Operation> An operation when the image forming apparatus according to the present embodiment starts printing will be described with reference to a timing chart in FIG. 5. In FIG. 5, a horizontal axis indicates the time axis, and a passing chart, a pressing chart, and a power chart are illustrated in the vertical direction. The passing chart shows a state whether the recording material is passing through the nip portion of the fixing device, and indicates whether the fixing operation is being performed. The "NO state" of the passing chart shows that the recording material is not passing, and "YES state" indicates that the recording material is passing. The pressing chart shows a state whether the pressure roller is pressed to the fixing roller in the fixing device. The "OFF state" of the pressing chart indicates a separated state in which the pressure of the pressure roller is released, and the "ON state" indicates a pressing state in which the pressure roller is pressed to the fixing roller. The power chart shows a state in which temperature-adjustment control of the fixing device is running. The "OFF state" of the power chart indicates a non-power-distribution state, and the "ON state" indicates a power-distribution state in which the temperature-adjustment control of the fixing roller is performed.

When a print instruction is issued, first, the state of the power chart becomes the "ON state" and power is input into the heater to heat the fixing device. If it is detected that the temperature of the fixing roller is a predetermined temperature, it is determined that the fixing operation can be performed, the image forming operation and the feeding operation are started, and the recording material on which an unfixed image is transferred is conveyed to the fixing device. Immediately before the recording material on which the unfixed image is transferred is conveyed to the fixing device and inserted into the fixing device, the state of the pressing chart becomes the "ON state" and the fixing operation is started. When a desired number of pages are output and the last recording material has passed through the fixing device, it is determined that the fixing operation is completed, the pressure of the pressing roller is released (the state of the pressing chart is the "OFF state"), and the state of the power chart is set to the "OFF state" to end the fixing operation.

Next, an operation of pressing (pressure) or separation (releasing the pressure) of the pressure roller during the printing operation will be described with reference to a flowchart in FIG. 6. During the fixing operation, whether the surface temperature of the pressure roller 52 is equal to or higher than the set temperature set lower than the melting point of the toner-parting agent is successively detected by the thermistor Th2 (see FIG. 2). The set temperature (here 70° C.) is set lower than the melting-point temperature (here 75° C.) of the wax, which is the toner-parting agent, so that, here, whether or not the surface temperature of the pressure roller 52 is equal to or higher than the set temperature (here equal to or higher than 70° C.) is detected (S11).

When a printing state changes and it is detected that the surface temperature of the pressure roller 52 is 70° C. which is the set temperature, the controlling portion C stops the image forming operation. Specifically, the controlling portion C (see FIG. 3) once stops the image forming operation and the feeding operation (S12), releases the pressure of the pressure roller, and separates the pressure roller from the fixing roller (S13). When a normal printing operation is continuously performed, the surface temperature of the pressure roller does not reach 75° C. which is the melting-point temperature of the wax. However, if an extreme printing operation is performed, the surface temperature of the pressure roller may reach 75° C. which is the melting-point temperature of the wax. For example, if an operation in which one page is output immediately after the previous page is output is repeatedly performed, heat is transferred from the fixing roller to the pressure roller and the temperature of the pressure roller rises because the period of time while the pressure roller is separated before and after the fixing operation is shorter than the period of time while one page is passing through during the continuous printing operation.

Therefore, after the surface temperature of the pressure roller becomes equal to or higher than 70° C. which is the set temperature set lower than the melting-point temperature of the wax, the pressure roller becomes a wait state until the temperature of the pressure roller is cooled down to a predetermined temperature (here equal to or lower than 65° C.) that is lower than the melting-point temperature of the wax so that the surface temperature of the pressure roller is maintained at a temperature equal to or lower than the set temperature. In the present embodiment, during the cooling-down operation, if the pressure roller is detected to be 65° C. (S14), it is determined that the cooling operation is completed, the pressure roller is pressed, the pressure roller is pressed onto the fixing roller (S15), the image forming operation and the feeding operation are restarted (S16), and the fixing operation is restarted (S17). By controlling in this way, when the recording material on which the toner image is formed is heated by the fixing device, the surface temperature of the pressure roller is maintained at a temperature lower than the set temperature set lower than the melting-point temperature of the toner-parting agent.

When the temperature of the pressure roller rises and the pressure roller is in a separated state (the pressure of the pressure roller is released), a cooling member (pressure member cooling unit) may be operated to cool down the pressure roller so that the waiting time is shortened. When the pressure roller is in the separated state, if "ON state" of the temperature-adjustment control of the fixing roller is maintained, the restart of the printing operation when the temperature of the pressure roller is low is smoothly performed.

Further, in the present embodiment, to prevent the temperature of the pressure roller from rising, intervals between the recording materials being conveyed are shortened so that the time in which the fixing roller and the pressure roller are in contact with each other is shortened. Specifically, A4 size recording sheets are output at 50 PPM in a process speed of 195 mm/sec, so that the time between the sheets is 0.07 sec.

<Effects and Mechanism> Here, a comparative example will be illustrated and described in order to compare the above-described present embodiment with the comparative example. As the comparative example, a case in which the pressure roller is started in the pressing state when the fixing operation is started, the printing operation is started while the temperature of the pressure roller is high by performing pre-rotation, and the fixing operation is performed without performing the control flow of FIG. 6 is illustrated and compared. The case in which the control flow of FIG. 6 is not performed is a case in which the fixing operation is performed without detecting whether the temperature of the pressure roller during the fixing operation is equal to or higher than the melting-point temperature of the wax. On the other hand, in the present embodiment, the fixing operation is performed by performing the control flow of FIG. 6. The adjustment temperature of the fixing roller is set to 170° C. in the comparative example and set to 180° C. in the present embodiment, so that approximately the same fixing performances are obtained.

In the comparative example, A4 size color laser copier papers of 80 g are output at 50 PPM in a process speed of 230 mm/sec, so that the time between the sheets is 0.21 sec.

FIG. 7 is a table illustrating the temperature of the pressure roller, the 60° gloss level of secondary color solid image, and the gloss variation of the comparative example and the present embodiment when the papers are output in the condition described above. The secondary color solid image is a portion where the toner-carrying amount is large, so that the density of the image is high. Therefore, the higher the gloss level is, the higher the image quality is. The gloss variation indicates the presence or absence of a gloss variation in the solid image formed by the conveying roller, the discharge roller, and the conveying guide after the papers pass through the fixing device.

In the present embodiment, when the recording material on which the toner image is formed is heated by the fixing device, it is controlled so that the surface temperature of the pressure roller is maintained at a temperature lower than the set temperature (here, 70° C.) set lower than the melting point (here, 75° C.) of the wax contained in the toner. However, in the comparative example, the temperature of the pressure roller may be equal to or higher than 75° C. which is the melting point of the wax of the toner.

As obvious from FIG. 7, regarding the gloss level and the gloss variation of the secondary color solid image, in the comparative example, the gloss level of the solid portion is lower than that of the present embodiment, and the gloss variation occurs in the solid portion. However, in the present embodiment, the gloss level of the solid portion is high and no gloss variation occurs.

Next, mechanism of the effects of the present embodiment will be described.

Figure 8:
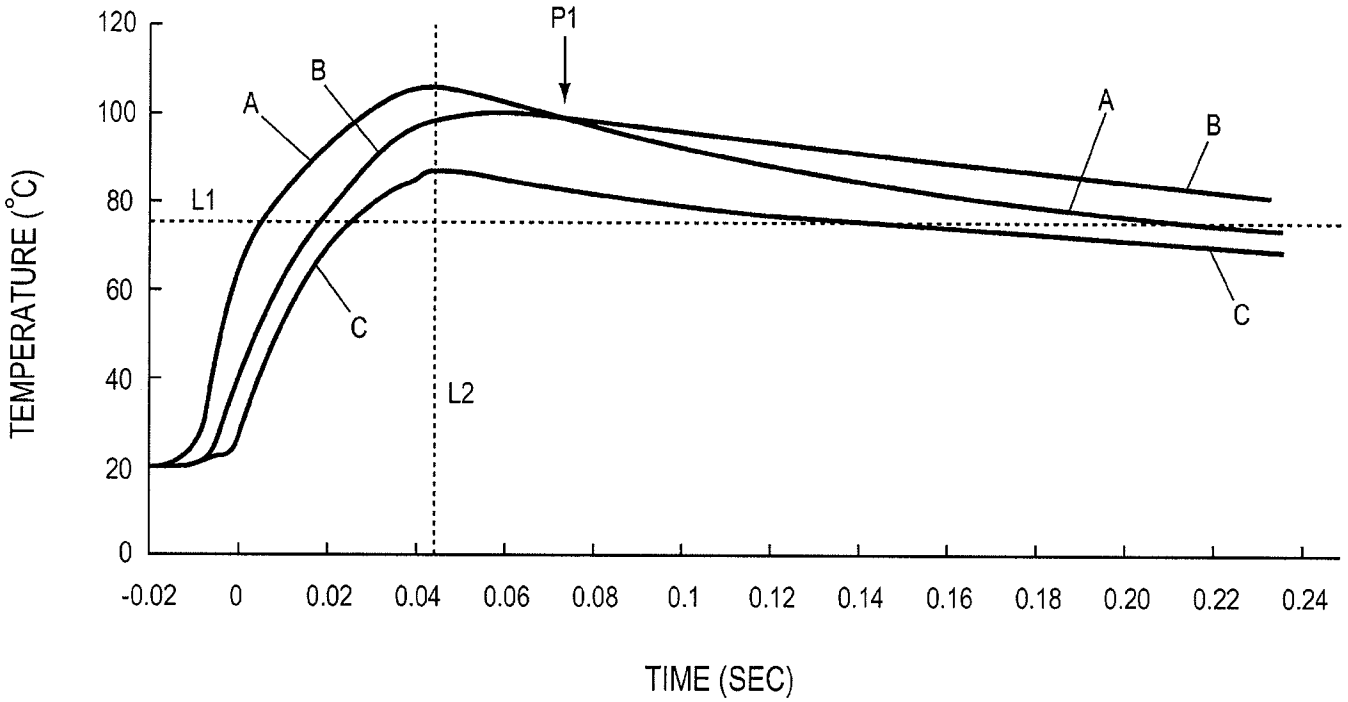
FIG. 8 is a graph illustrating a result in which temperatures of a recording material and a toner image that are passing through a fixing nip portion are measured in the comparative example.

FIG. 8 is a result in which temperatures of the recording material and the toner image that are passing through the fixing nip portion are measured in the same condition as that of the comparative example. In FIG. 8, the line A indicates a surface temperature of the toner (upper layer toner temperature) in contact with the fixing roller in the nip portion, the line B indicates an interface temperature between the toner and the recording material (lower layer toner temperature), and the line C indicates a rear surface temperature of the recording material in contact with the pressure roller.

Figure 12A:
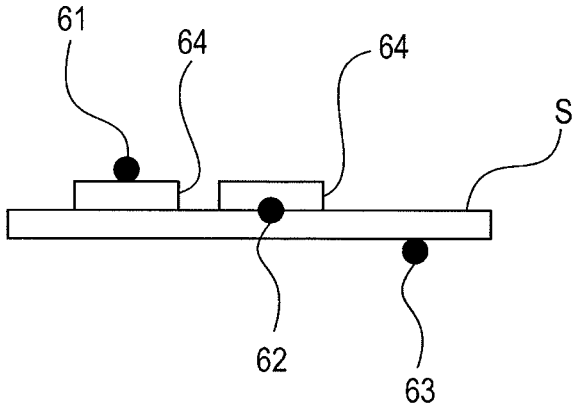
FIGS. 12A and 12B are explanatory diagrams illustrating a method for measuring the temperatures of the recording material and the toner image.
Figure 12B:
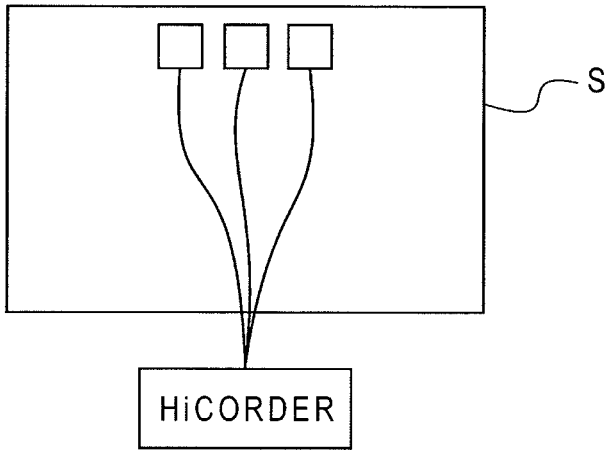

Regarding the method for measuring the temperatures, as illustrated in FIGS. 12A and 12B, thermocouples 61, 62, and 63 are fixed to the recording material P on which polyester tapes (PES tapes) 64 having a predetermined thickness are attached instead of toner, and thermocouples 61, 62, and 63 are passed through the fixing device 9 along with the recording material P, so that the temperature rising curve in the fixing nip portion is measured. Here, superfine thermocouples KFST-10-100-200 manufactured by ANBE SMT Co. are used for the thermocouples 61, 62, and 63. The thermocouple 61 simulates the toner surface temperature, the thermocouple 62 simulates the interface temperature between the toner and the recording material, and the thermocouple 63 simulates the rear surface temperature of the recording material which comes into contact with the pressure roller. The PES tape 64 having a thickness of 10 μm is used. MEMORY HiCORDER 8855 by HIOKI E. E. CORPORATION is used for the data analysis. The thermocouples 61, 62, and 63 are connected to each of input terminals of the MEMORY HiCORDER and the temperatures measured by the thermocouples are recorded.

The line L1 in FIG. 8 indicates the melting-point temperature (75° C.) of the wax of the toner and corresponds to the temperature at which the endothermic amount indicates the peak (point P) in the relationship between the toner temperature and the endothermic amount described with reference to FIG. 4. The line L2 indicates the timing at which the toner is discharged from the fixing device.

In FIG. 8, the lines A, B, and C indicate the temperatures rise in the fixing nip. The line A indicates the highest temperature, the line B indicates the second highest temperature, and the line C indicates the lowest temperature. However, at the point P1 near 0.07 sec after the line L2 at which the toner is discharged from the fixing nip portion, the temperatures indicated by the lines A and B are reversed. In other words, the interface temperature between the toner and the recording material becomes higher than the toner surface temperature. The temperature at the point P1 is higher than the melting point of the wax 75° C., so it means that the wax on the toner surface solidifies earlier than the wax near the interface between the toner and the recording material.

After the toner passes the point P1, all the lines A, B, and C indicate that the temperatures fall. At the point of 0.14 sec, the rear surface temperature of the recording material (line C) first becomes lower than the melting-point temperature of the wax (line L1). Next, at the point of 0.21 sec, the toner surface temperature (line A) becomes lower than the melting-point temperature of the wax (line L1). Finally, the interface temperature between the toner and the recording material (line B) becomes lower than the melting-point temperature of the wax (line L1). Incidentally, at a point near 0.34 sec, the interface temperature between the toner and the recording material (line B) becomes lower than the melting-point temperature of the wax (line L1).

Figures 10A, 10B, 10C, 10D, 10E:
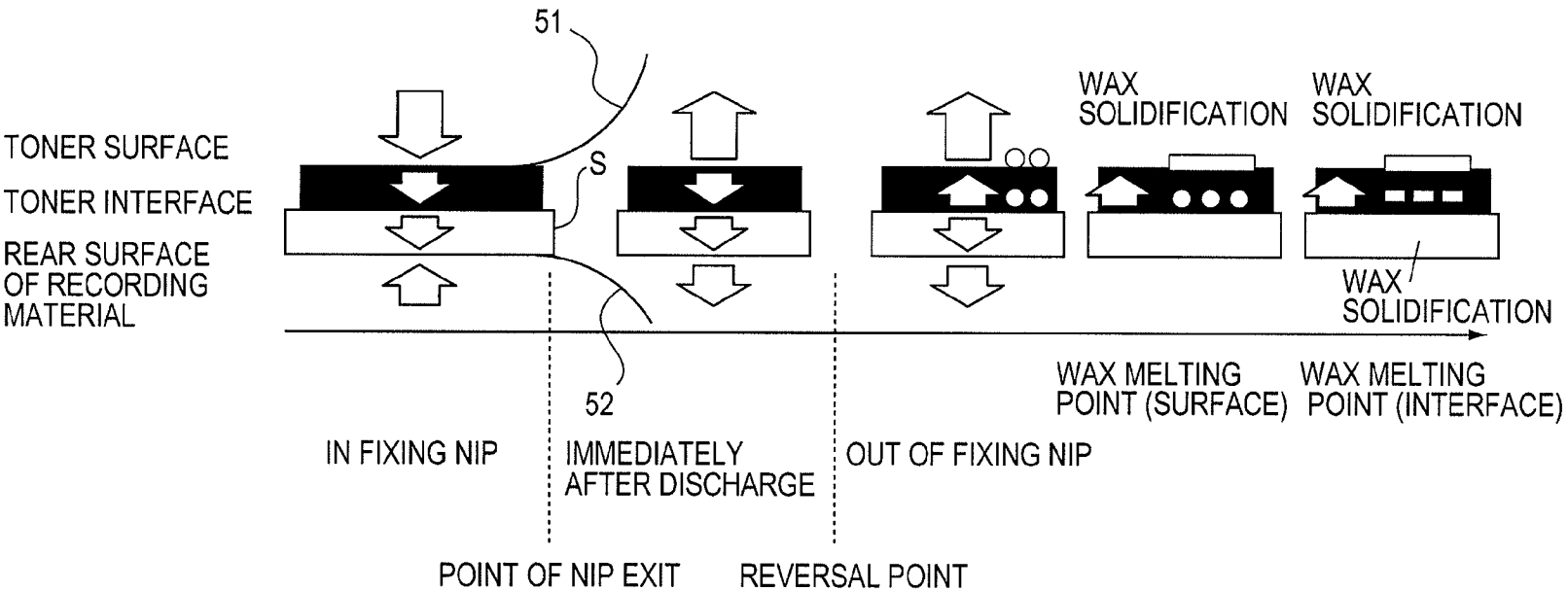
FIGS. 10A to 10E are schematic cross-sectional views for explaining a state change inside the recording material and a toner layer in the comparative example.

Next, the state change inside the toner layer on the recording material in the temperature state of the comparative example will be described with reference to FIG. 10. From FIGS. 10A to 10E, the state of the toner and the recording material in the fixing nip portion and the state of the toner and the recording material after being discharged from the fixing nip portion are illustrated in time series. The arrows in the drawings indicate flows of the temperatures.

First, from when the toner is in the fixing nip portion to when the toner is about to be discharged from the nip portion, the rear surface temperature of the recording material is the lowest, and the heat moves from the toner surface to the toner interface and the rear surface of the recording material. Immediately after the toner is discharged from the nip portion, the fixing roller that is the heat source is not in contact with the pressure roller, so the heat is dissipated from the toner surface and the rear surface of the recording material. The reversal point in FIG. 10 corresponds to the point P1 indicated in FIG. 8 at which the temperature of the toner surface becomes lower than the temperature of the toner interface. After the reversal point, the temperature gradient and the heat flow are reversed and the heat flows from the inside of the toner to the surface of the toner.

If the toner and the recording material are cooled down while the temperature gradient of the toner surface temperature and the toner interface temperature is reversed, the wax solidifies at the timing when the temperature becomes lower than the melting-point temperature of the wax, so that wax solidification starts from the wax on the surface. Thereafter, the temperature of the toner falls, and finally, the wax near the interface inside the toner solidifies. If the wax on the toner surface solidifies first while the wax inside the toner does not solidify, the toner is easily deformed because the hardness inside the toner, which is the base of the toner, is low. In such a state, specifically, after the point of 0.21 sec illustrated in FIG. 8 at which the wax on the toner surface solidifies, when the conveying roller comes into contact with the toner surface, the base (inside of the toner) is affected by a pressing force and deformed, so that a gloss variation due to the conveying roller easily occurs.

Further, when the wax on the toner surface solidifies first while the wax in the lower layer of the toner does not solidify, the gloss variation occurs when the toner receives external disturbances such as air flow, contact with the conveying guide, and the like.

In the comparative example, it is considered that the gloss variation occurs because the conveying roller is disposed near the point of 0.25 sec.

Figure 9:
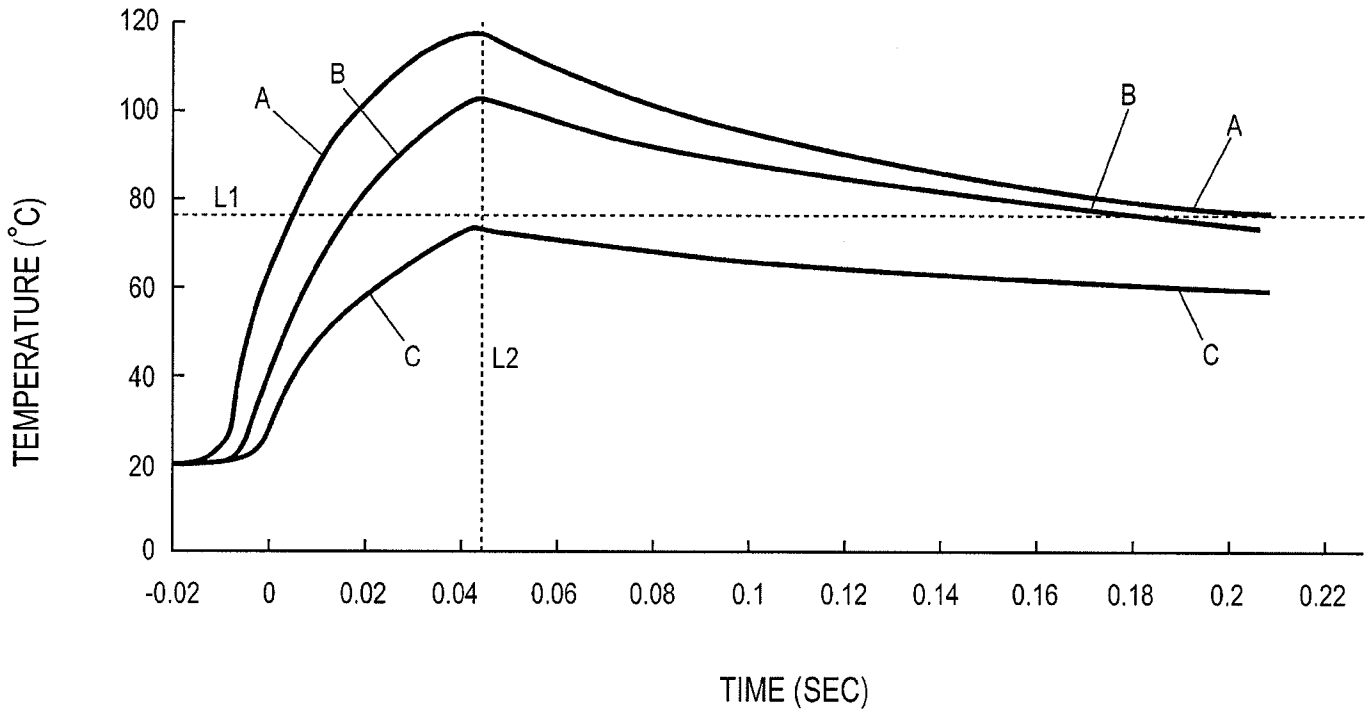
FIG. 9 is a graph illustrating a result in which temperatures of a recording material and a toner image that are passing through a fixing nip portion are measured in the present embodiment.

In the present embodiment, in the same manner as in the comparative example, the temperatures of the recording material and the toner image that are passing through the fixing nip portion are measured. The result is illustrated in FIG. 9. In the present embodiment, to obtain the same fixing performance as that of the comparative example, the temperature (line B) of the interface between the toner and the recording material is set to substantially the same as that of the comparative example. Therefore, the temperature of the fixing roller is set to be higher than that of the comparative example by a predetermined temperature (here, 10° C.). As a result, the surface temperature (line A) of the toner is higher than that of the comparative example by several degrees.

Figure 6:
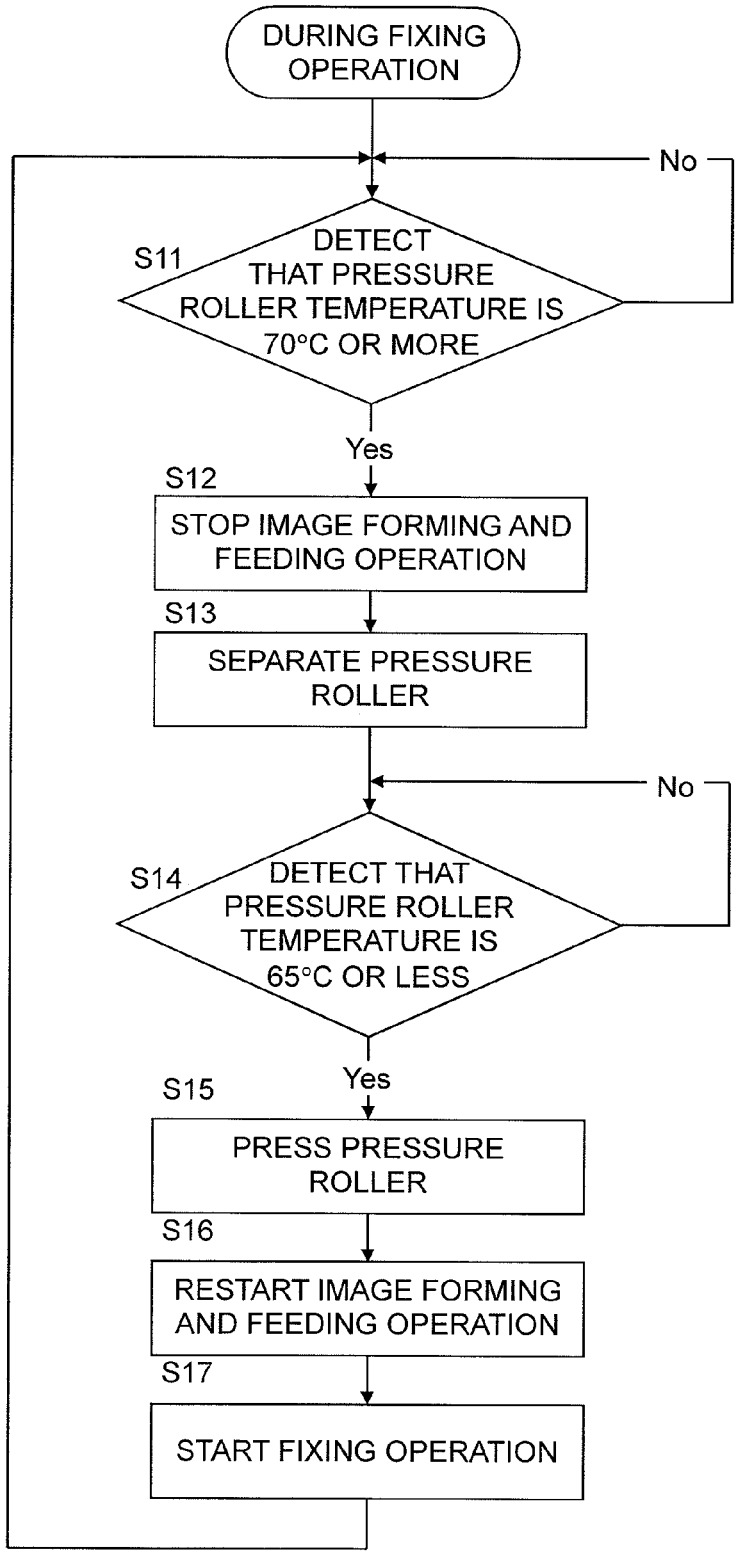
FIG. 6 is a flowchart illustrating an operation of the image forming apparatus according to the first embodiment.

Further, in the present embodiment, according to the control flow illustrated in FIG. 6, it is controlled so that the surface temperature of the pressure roller is kept at a temperature lower than the set temperature (here, 70° C.) set lower than the melting point (here, 75° C.) of the wax of the toner. Therefore, the interface temperature (the rear surface temperature of the recording material, line C) of the recording material that comes into contact with the pressure roller is not higher than the melting-point temperature of the wax when the recording material is passing through the fixing nip portion.

Further, after the recording material is discharged from the fixing device, the recording material is cooled down from the rear surface thereof by the cooling fan 60 (see FIG. 1). Therefore, the temperature (line C) of the rear surface of the recording material falls quickly. The cooling fan 60 is a cooling unit for cooling the surface of the recording material which is in contact with the pressure roller 52 at the nip portion N of the fixing device after the surface passes through the nip portion.

In this way, the rear surface temperature (line C) of the recording material is lower than the melting-point temperature of the wax, so that the interface (line B) between the toner and the recording material is cooled down from the rear surface of the recording material. As obvious from FIG. 9, it is found that the temperature (line B) of the interface between the toner and the recording material becomes lower than the melting-point temperature of the wax in about 0.1 sec after being discharged from the fixing device earlier than the temperature (line A) of the toner surface. In other words, by changing the condition of the fixing device at the nip portion N, when the temperature (line A) of the surface of the toner layer reaches the line L1 (here, the melting-point temperature of the wax), the temperature (line B) of the interface between the toner and the recording material is lower than the line L1. Specifically, by controlling the operation of the pressure roller pressure portion as describe above, the surface temperature of the pressure roller is kept below the set temperature which is set lower than the melting point of the wax. The features of the present embodiment described above are different from those of the comparative example.

In the present embodiment, the rear surface temperature (line C) of the recording material is lower than the melting-point temperature (line L1) of the wax from immediately after the fixing operation, and next, the interface temperature (line B) between the toner and the recording material becomes lower than the melting-point temperature (line L1) of the wax at a point around 0.18 sec. Finally, the surface temperature (line A) of the toner becomes lower than the melting-point temperature (line L1) of the wax at a point around 0.21 sec.

Figures 11A, 11B, 11C, 11D, 11E:
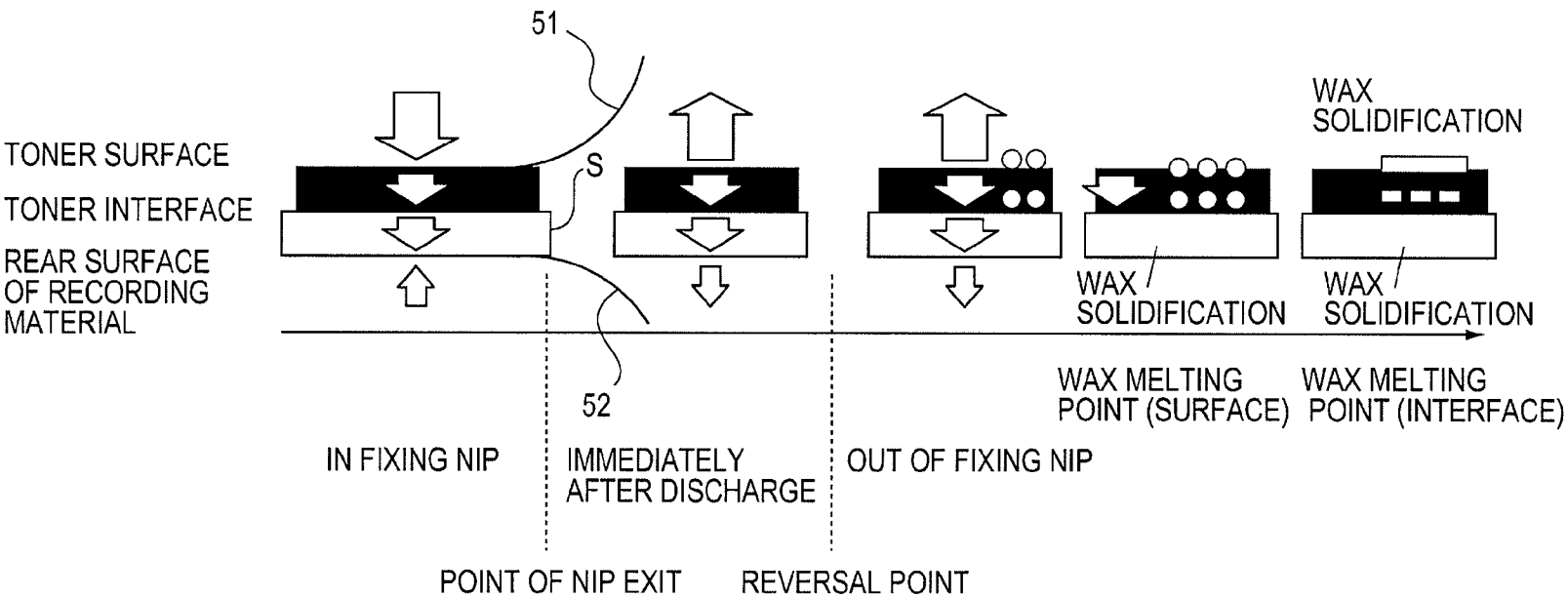
FIGS. 11A to 11E are schematic cross-sectional views for explaining a state change inside the recording material and the toner layer in the present embodiment.

Next, the state change inside the toner layer on the recording material in the present embodiment will be described with reference to FIG. 11. From FIGS. 11A to 11E, the state of the toner and the recording material in the fixing nip portion and the state of the toner and the recording material after being discharged from the fixing nip portion are illustrated in time series. The arrows in the drawings indicate flows of the temperatures.

In the temperature state of the present embodiment, the temperature gradient in the fixing nip portion is the same as that illustrated in FIG. 10. However, the temperature of the pressure roller is controlled to be lower than that of the comparative example, and the rear surface temperature of the recording material is lower than the melting-point temperature of the wax. Therefore, before the reversal of the temperature gradient as shown in the comparative example occurs, the interface temperature between the toner and the recording material becomes lower than the melting-point temperature of the wax. Therefore, the illustration of the wax melting point (interface) in FIG. 11 corresponding to the point of 0.14 sec in FIG. 9 indicates that the wax at the interface between the toner and the recording material solidifies earlier than the wax at the toner surface. Thereafter, the illustration of the wax melting point (surface) in FIG. 11 corresponding to the point of 0.21 sec in FIG. 9 indicates that the waxes at both the surface of the toner and the interface (interface with the recording material) solidify.

In such a cooling process, the wax at the toner surface solidifies after the base is stabilized, so that, when the conveying roller comes into contact with the toner surface after the wax at the toner surface solidifies, the gloss variation is hard to occur.

When both waxes at the inside and the surface of the toner solidify, the toner surface is not affected by external disturbances and the gloss variation does not occur. However, it takes time for the wax inside the toner to solidify naturally, so that the conveying path of the recording material is prolonged to cool down the toner in a high-speed machine, and thus it is not preferable.

Therefore, it is necessary to cool down the toner and quickly solidify the wax of the toner. As described above, when the toner is cooled down from the lower layer and the wax is solidified from the lower layer, the toner surface is stabilized much easier than when the toner is cooled down from the surface and the wax is solidified from the surface.

From the reason described above, as in the present embodiment, when the wax is solidified from the lower layer of the toner, the surface is hard to be disturbed, the gloss of the image is enhanced, and it is hard for a gloss variation, due to the conveying roller and the like, to occur. Therefore, in the present embodiment, even when the conveying roller is disposed at the point of 0.25 sec, no gloss variation occurs. Further, the toner surface is stabilized easily, so that the gloss of the image is enhanced.

As described above, the temperature of the pressure roller is kept lower than the melting-point temperature of the wax, so that the lower layer of the toner is cooled down from the rear surface of the recording material, and the reversal between the temperature of the toner surface and the temperature of the interface between the toner and the recording material in the cooling process is prevented. Thus, in the recording material that has passed through the nip portion of the fixing device, first, the temperature at the interface between the toner layer forming an image and the recording material is cooled down to the melting-point temperature of the toner-parting agent, gradually the toner layer is cooled down from the interface to the toner surface, and finally the temperature at the toner surface is cooled down to the melting-point temperature of the toner-parting agent. In other words, in the recording material that has passed through the nip portion of the fixing device, the toner layer forming an image solidifies from the lower layer of the toner layer (from the surface of the recording material), and thereafter, the area near the surface of the toner layer solidifies. As a result, when the surface layer of the toner image solidifies, the rigidity of the wax of the lower layer, which is the base of the toner image, is high, so that a uniform surface without a gloss variation can be obtained and a highly glossy image can be obtained. Further, when duplex printing is performed, good glossy images can be obtained.

Other Embodiments

In the embodiment described above, as a configuration for changing the condition of the fixing device at the nip portion, the operation of the pressure roller pressure portion (contact and separation between the fixing roller and the pressure roller) and the cooling of the pressure roller by the cooling member are illustrated. However, it is not limited to those. For example, a configuration using either one of the contact and separation between the fixing roller and the pressure roller and the cooling of the pressure roller by the cooling member is possible. Other configurations (configurations as described below) are possible under a condition in which, when the fixing device heats the recording material on which the toner image is formed, if the surface temperature of the toner layer reaches the melting point of the toner-parting agent, the temperature of the interface between the toner layer and the recording material is lower than the temperature of the surface of the toner.

In the embodiment described above, the pressure roller in which the elastic layer is formed on the metal core and further the toner-parting property layer is coated on the elastic layer is illustrated as the pressure member. However, it is not limited to this. For example, the roller may be a roller in which a material such as a sponge with low heat capacity and low thermal conductivity is used for the pressure member. When the sponge type roller is used as the pressure member, the thermal conductivity and the heat capacity are small, so that the temperature of the pressure roller is hard to rise, and the heat transferred to the rear surface of the recording material in the fixing nip portion is small. Thus, the same effects as those in the embodiment described above can be obtained. In this case, even if the temperature-adjustment control of the fixing roller and the temperature control of the pressure roller are the same as those of the embodiment described above, sufficient effects can be obtained.

It is possible to increase the temperature difference between the toner surface and the recording material interface by narrowing the width of the fixing nip portion in the recording material conveying direction, so that the same effects as those in the embodiment described above can be obtained. For example, in the embodiment describe above, the nip width is 7 mm and the adjustment temperature is 180° C. However, when the nip width is 5 mm and the adjustment temperature is 200° C., the same fixing performance and the same effects can be obtained.

In the embodiment described above, the fixing device which thermally melts an image that is formed on the recording material by using toner containing a toner-parting agent and fixes the image onto the recording material is illustrated as the image heating device (image heating means). However, it is not limited to this. For example, the image heating device may be other image heating devices such as a gloss enhancing device which enhances gloss of an image by heating the image fixed to the recording material.

Although, in the embodiment described above, four image forming portions are used, the number of the image forming portions is not limited and the image forming portions may be provided as needed.

Although, in the embodiment described above, a printer is illustrated as the image forming apparatus, the present invention is not limited to this. For example, the image forming apparatus may be other image forming apparatuses such as a copying machine and a facsimile machine, or other image forming apparatuses such as a multifunction machine in which these functions are combined. Or, the image forming apparatus may be an image forming apparatus which uses a recording-material carrying member and sequentially transfers and superimposes toner images of each color onto a recording material carried on the recording-material carrying member. The present invention is applied to the image forming apparatus, so that the same effects can be obtained.

According to the present invention, in the recording material that has passed through the nip portion of the fixing device, first, the temperature at the interface between the toner layer forming an image and the recording material is cooled down to the melting-point temperature of the toner-parting agent, gradually the toner layer is cooled down from the interface to the toner surface, and finally the temperature at the toner surface is cooled down to the melting-point temperature of the toner-parting agent. In other words, in the recording material that has passed through the nip portion of the fixing device, the toner layer forming an image solidifies from the lower layer of the toner layer (from the surface of the recording material), and thereafter, the area near the surface of the toner layer solidifies. As a result, when the surface layer of the toner image solidifies, the rigidity of the wax of the lower layer, which is the base of the toner image, is high, so that a uniform surface without a gloss variation can be obtained and a highly glossy image can be obtained. Further, when duplex printing is performed, good glossy images can be obtained.

Although the embodiments of the present invention have been described, the present invention is not limited by the above-described embodiments, and various modifications are possible within the scope of the technical idea of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-245850, filed Nov. 2, 2010, which is hereby incorporated by reference herein in its entirety.

What is claimed is:

1. An image forming apparatus comprising:

an image forming portion configured to form a toner image on a recording material using toner containing a wax component;

a fixing portion configured to fix the toner image on the recording material, said fixing portion including a heating rotatable member configured to heat the toner image on the recording material at a nip portion, a pressure rotatable member configured to form the nip portion cooperatively with said heating rotatable member, and a cooling portion configured to cool said pressure rotatable member; and a controlling portion configured to control an operation of said fixing portion, wherein said controlling portion controls a cooling condition of said cooling portion so that a temperature of said pressure rotatable member is kept at a first temperature lower than a second temperature at which an endothermic amount of the toner indicates a main peak, and wherein said controlling portion controls a fixing condition of said fixing portion so that an interfacial temperature between a toner layer and the recording material becomes a temperature that is lower than a temperature of an outermost surface of the toner layer when the temperature of the outermost surface of the toner layer reaches the second temperature in the case that the toner image having a maximum toner amount per unit area is formed.

2. The image forming apparatus according to claim 1, further comprising a temperature detector configured to detect a temperature of said pressure rotatable member, wherein said controlling portion controls the cooling condition of said cooling portion based on an output of said temperature detector.

3. The image forming apparatus according to claim 1, further comprising a moving mechanism configured to move said pressure rotatable member relative to said heating rotatable member between a position where said heating rotatable member and said pressure rotatable member contact each other and a position where said heating rotatable member and said pressure rotatable member are separated from each other, wherein said controlling portion controls an operation of said moving mechanism, as the fixing condition.

4. The image forming apparatus according to claim 3, further comprising a temperature detector configured to detect a temperature of said pressure rotatable member, wherein said controlling portion interrupts an image forming operation of said apparatus if the temperature detected by said temperature detector reaches a predetermined temperature that is higher than the first temperature and that is lower than the second temperature.

5. The image forming apparatus according to claim 2, wherein said pressure rotatable member is disposed so as to contact an opposite surface of the recording material, with respect to a surface on which the toner image is formed.

6. An image forming apparatus comprising:

an image forming portion configured to form a toner image on a recording material using toner containing a wax component;

a fixing portion configured to fix the toner image on the recording material, said fixing portion including a heating rotatable member configured to heat the toner image on the recording material at a nip portion, a pressure rotatable member configured to form the nip portion cooperatively with said heating rotatable member, and a temperature detector configured to detect a temperature of said pressure rotatable member; and a controlling portion configured to control an operation of said image forming portion and said fixing portion, wherein said controlling portion keeps the temperature of said pressure rotatable member at a first temperature lower than a second temperature at which an endothermic amount of the toner indicates a main peak so that an interfacial temperature between a toner layer and the recording material becomes a temperature that is a temperature of an outermost surface of the toner layer when the temperature of the outermost surface of the toner layer reaches the second temperature, in the case that a toner image having a maximum toner amount per unit area is formed, and wherein said controlling portion interrupts an image forming operation of said apparatus if the temperature detected by said temperature detector reaches a predetermined temperature that is higher than the first temperature and that is lower than the second temperature.

7. The image forming apparatus according to claim 6, further comprising a moving mechanism configured to move said pressure rotatable member relative to said heating rotatable member between a position where said heating rotatable member and said pressure rotatable member contact each other and a position where said heating rotatable member and said pressure rotatable member are separated from each other, wherein said controlling portion controls an operation of said moving mechanism, as the fixing condition.

8. The image forming apparatus according to claim 6, wherein said pressure rotatable member is disposed so as to contact to opposite surface of the recording material, with respect to a surface on which the toner image is formed.

* * * * *